US005267631A

United States Patent [19]

Mendel

[11] Patent Number: 5,267,631

[45] Date of Patent: Dec. 7, 1993

[54] SCAFFOLD STABILIZER APPARATUS

[76] Inventor: Gary S. Mendel, 15250 Sellers Rd., Houston, Tex. 77060

[21] Appl. No.: 939,657

[22] Filed: Sep. 3, 1992

[51] Int. Cl.[5] ..... E04G 5/00

[52] U.S. Cl. ..... 182/107; 182/172

[58] Field of Search ..... 182/107, 172, 108, 203, 182/178, 179

[56] References Cited

U.S. PATENT DOCUMENTS 4,175,641 11/1979 Reyes ..... 182/172

4,964,488 10/1990 Stewart ..... 182/172 X

FOREIGN PATENT DOCUMENTS 324380 9/1902 France ..... 182/172

990381 9/1951 France ..... 182/172

*Primary Examiner*—Alvin C. Chin-Shue

*Attorney, Agent, or Firm*—Leon Gilden

[57] ABSTRACT

An apparatus to include a stairwell stabilizer having a tripod leg structure to effect stability relative to a central support tube, having an extension tube directed therefrom. The extension tube includes a support rod orthogonally mounted medially of itself to an upper distal end of the extension tube, with the support rod having extension legs directed exteriorly of each end of the support rod. Each extension leg includes an abutment flange having an abrasive exterior surface to support scaffold planks thereon. A further scaffold stabilizer structure includes laterally extending mounting bars pivotally mounted to upper distal ends of a scaffold structure at opposed sides thereof, wherein each mounting bar includes a slide tube, with each slide tube having stabilizer rods directed therefrom, wherein the stabilizer rods are secured to opposed sides of a scaffold structure for stability.

1 Claim, 4 Drawing Sheets

SCAFFOLD STABILIZER APPARATUS

BACKGROUND OF THE INVENTION

1. Field of the Invention

The field of invention relates to scaffold stabilizing structure, and more particularly pertains to a new and improved scaffold stabilizer apparatus wherein the same is arranged to effect stability relative to various scaffold organizations.

2. Description of the Prior Art

Scaffolds and scaffold support structure have been utilized throughout the prior art for the maintaining of scaffolds in a predetermined and desired secured orientation for use. Such scaffold structure is exemplified in the U.S. Pat. Nos. 4,187,929; 4,877,107; 4,942,940; and 5,016,735.

Heretofore, however, the stabilizer support structure of the prior art has failed to provide for a rigid organization universally arranged for support and mounting of various scaffold configurations and in this respect, the present invention substantially fulfills this need.

SUMMARY OF THE INVENTION

In view of the foregoing disadvantages inherent in the known types of scaffold apparatus now present in the prior art, the present invention provides a scaffold stabilizer apparatus wherein extension leg structure is arranged to secure a scaffold member in a sandwiched orientation therebetween. As such, the general purpose of the present invention, which will be described subsequently in greater detail, is to provide a new and improved scaffold stabilizer apparatus which has all the advantages of the prior art scaffold apparatus and none of the disadvantages.

To attain this, the present invention provides an apparatus to include a stairwell stabilizer having a tripod leg structure to effect stability relative to a central support tube, having an extension tube directed therefrom. The extension tube includes a support rod orthogonally mounted medially of itself to an upper distal end of the extension tube, with the support rod having extension legs directed exteriorly of each end of the support rod. Each extension leg includes an abutment flange having an abrasive exterior surface to support scaffold planks thereon. A further scaffold stabilizer structure includes laterally extending mounting bars pivotally mounted to upper distal ends of a scaffold structure at opposed sides thereof, wherein each mounting bar includes a slide tube, with each slide tube having stabilizer rods directed therefrom, wherein the stabilizer rods are secured to opposed sides of a scaffold structure for stability.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scaffold stabilizer apparatus which has all the advantages of the prior art scaffold apparatus and none of the disadvantages.

It is another object of the present invention to provide a new and improved scaffold stabilizer apparatus which may be easily and efficiently manufactured and marketed.

It is a further object of the present invention to provide a new and improved scaffold stabilizer apparatus which is of a durable and reliable construction.

An even further object of the present invention is to provide a new and improved scaffold stabilizer apparatus which is susceptible of a low cost of manufacture with regard to both materials and labor, and which accordingly is then susceptible of low prices of sale to the consuming public, thereby making such scaffold stabilizer apparatus economically available to the buying public.

Still yet another object of the present invention is to provide a new and improved scaffold stabilizer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
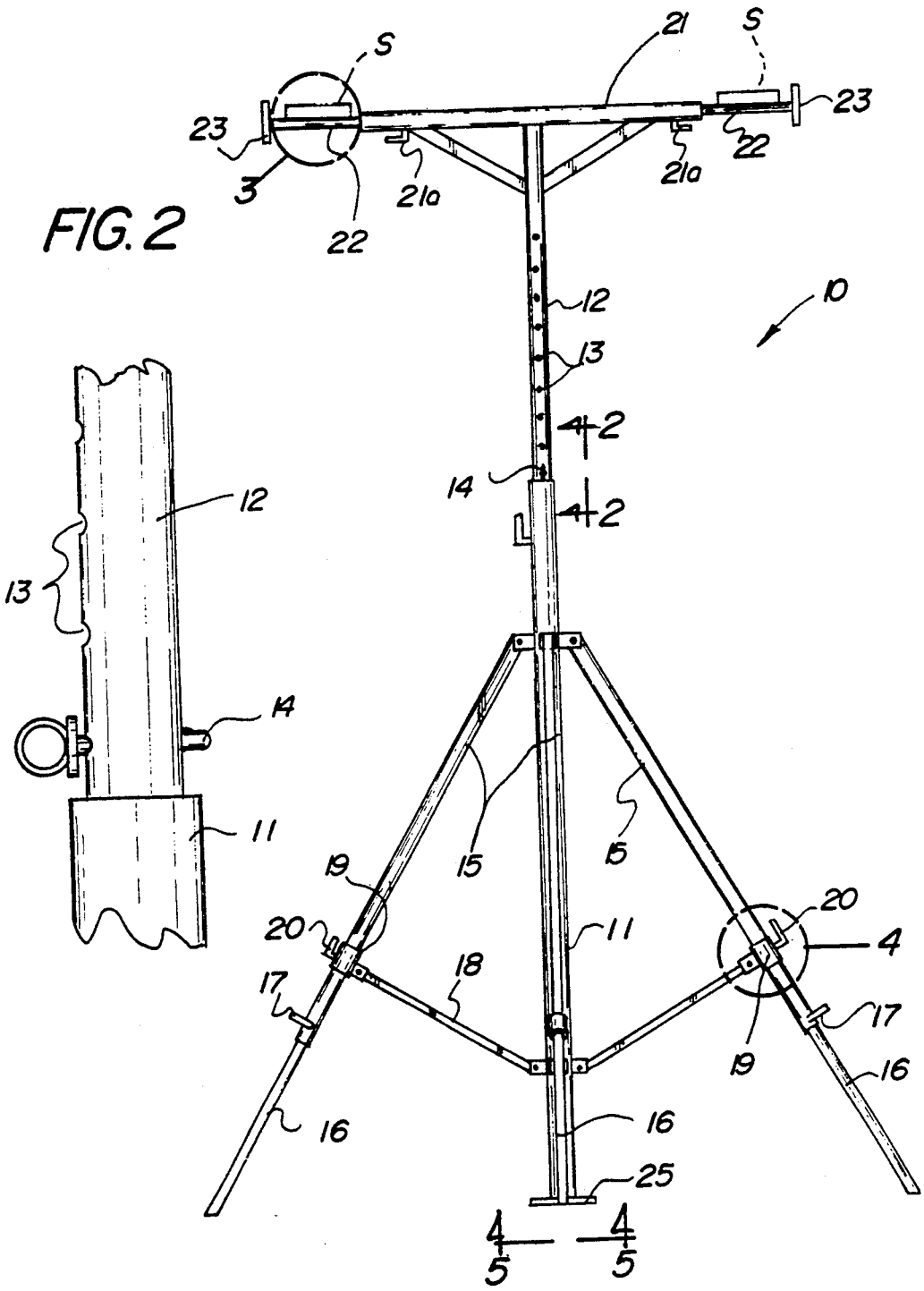
FIG. 1 is an orthographic view of a scaffold stabilizer apparatus utilized by the invention.
FIG. 2 is an orthographic view, taken along the lines 2—2 of FIG. 1 in the direction indicated by the arrows.
Figure 3:
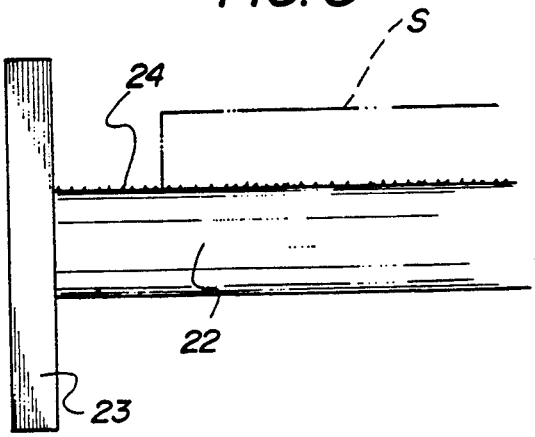
FIG. 3 is an orthographic view of section 3 as set forth in FIG. 1.
Figure 4:
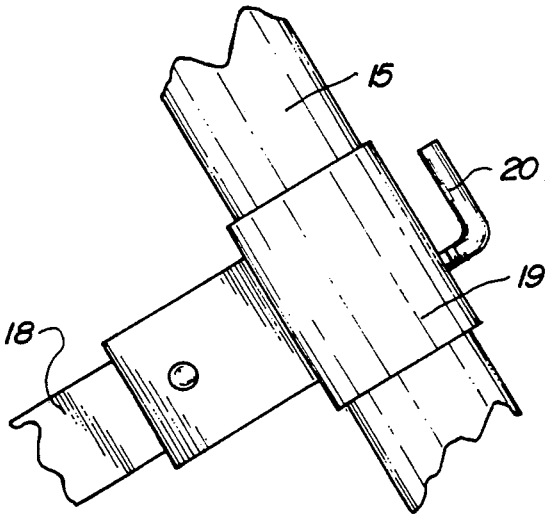
FIG. 4 is an orthographic view of section 4 as set forth in FIG. 1.
Figure 5:
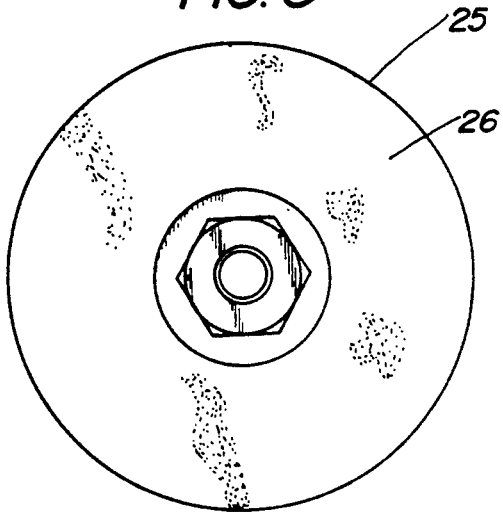
FIG. 5 is an orthographic view of section 5 as set forth in FIG. 1.

With reference now to the drawings, and in particular to FIGS. 1 to 9 thereof, a new and improved scaffold stabilizer apparatus embodying the principles and concepts of the present invention and generally designated by the reference numerals 10 and 10*a* will be described.

More specifically, the scaffold stabilizer apparatus 10 of the instant invention as indicated in FIG. 1 essentially comprises a support tube 11 having an extension tube 12 mounted relative to an upper distal end of the support tube 11. The extension tube 12 includes a row of tube bores 13 to selectively receive a lock pin 14 therethrough, in a manner as indicated in FIG. 2, to limit retraction of the extension tube 12 relative to the support tube 11. A trio of individual tripod legs 15 are pivotally mounted at their upper distal ends in a spaced relationship relative to the support tube upper distal end, wherein each of the tripod legs 15 includes a tripod leg extension leg selectively extending therefrom utilizing a leg lock fastener 17 to selectively secure each extension leg relative to a respective tripod leg 15. Each tripod leg further includes a tripod leg connecting link 18 having a link tube 19 slidably mounted along one of the respective tripod legs 15 secured along said tripod leg by a link tube fastener 20. Each connecting link 18 is also pivotally mounted in a concentric annular orientation about the support tube 11 spaced above a lower distal end of the support tube that in turn includes a support tube base plate 25 having a friction pad bottom surface 26 thereon.

The extension tube 12 includes a support rod 21 orthogonally and integrally mounted to an upper distal end of the extension tube 12 medially of the support rod 21. The support rod includes an extension leg 22 telescopingly directed from each end of the support rod 21 employing support rod fasteners 21*a* to selectively affix extension of each support rod extension leg 22 relative to the support rod 21. Each extension leg includes an extension leg abutment flange 23 mounted at the outer end of each extension leg to position a scaffold plank on the extension leg surface. The extension leg exterior surface is further formed with a matrix of abrasive projections 24 extending therefrom to minimize slippage of an associated scaffold plank relative to the extension leg exterior surface (see FIG. 3).

Figure 6:
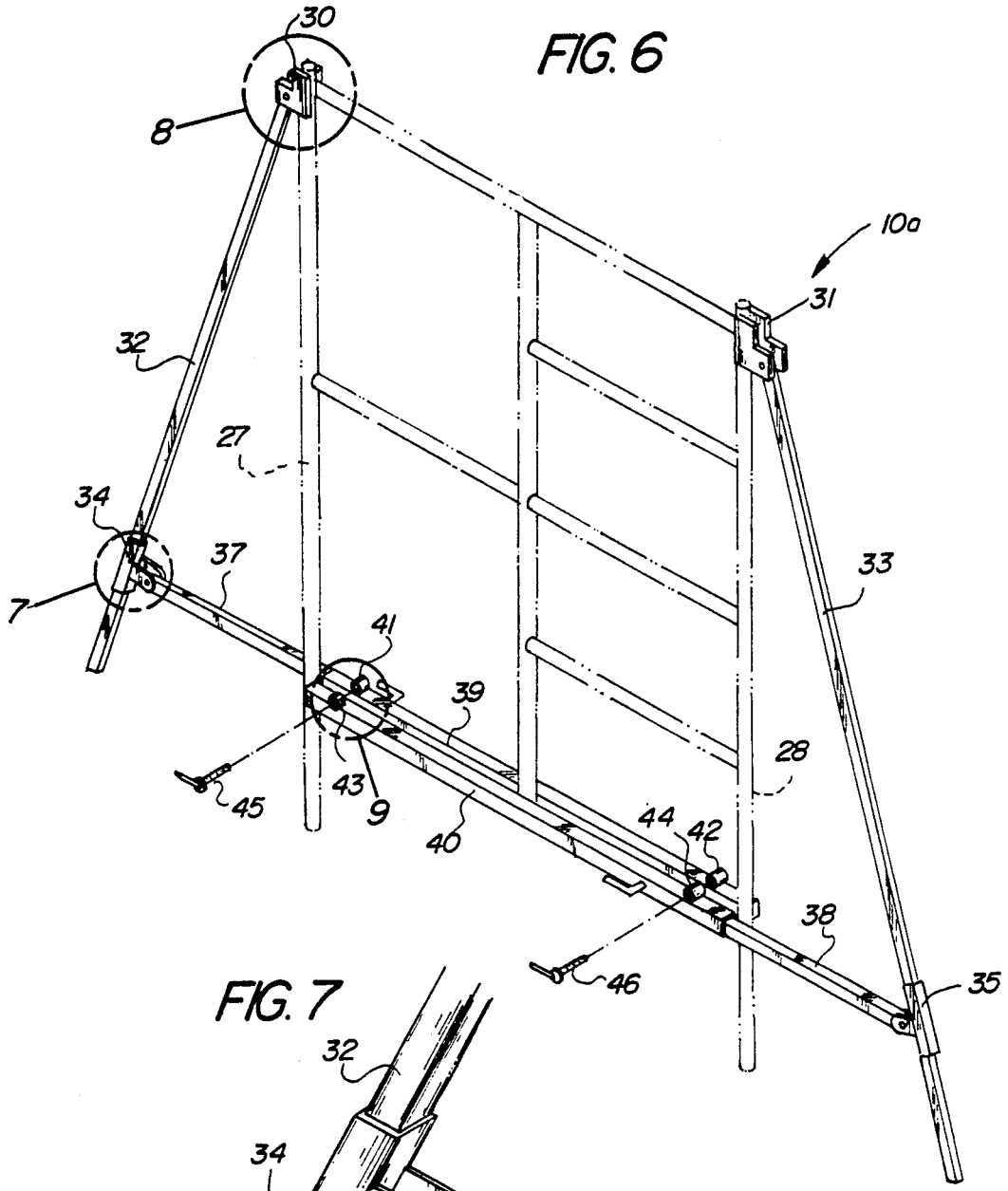
FIG. 6 is an isometric illustration of a further scaffold stabilizer apparatus of the invention.
Figure 7:
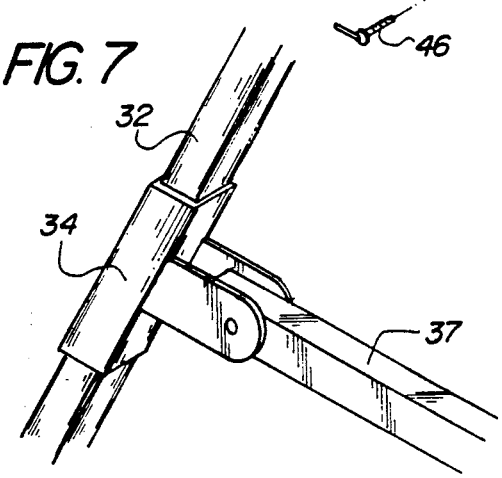
FIG. 7 is an isometric illustration of section 7 as set forth in FIG. 6.
Figures 8, 9:
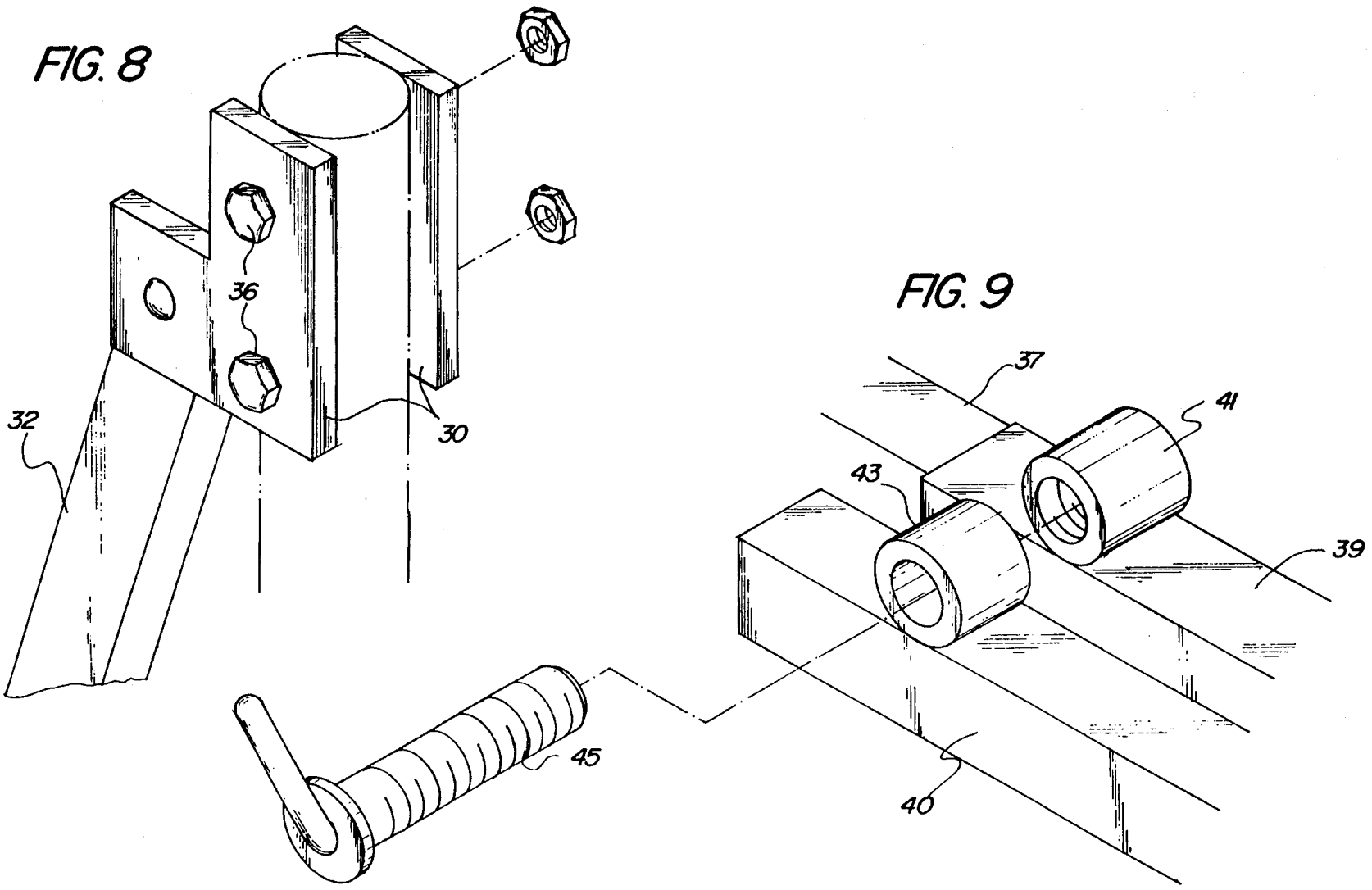
FIG. 8 is an isometric illustration of section 8 as set forth in FIG. 6.
FIG. 9 is an isometric illustration of section 9 as set forth in FIG. 6.

A further scaffold stabilizer apparatus 10*a* is indicated in the FIGS. 6–9 for securement relative to scaffold structure having a scaffold first tube 27 spaced from and parallel a scaffold second tube 28, with a scaffold top tube 29 orthogonally intersecting the scaffold first and second tubes 27 and 28 in a fixed relationship. Respective first and second mounting plate pairs 30 and 31 are mounted to the respective first and second tubes 27 and 28 adjacent the scaffold first tube upper distal end and the scaffold second tube upper distal end respectively. A first mounting bar 32 includes a first mounting bar upper distal end pivotally mounted between the first mounting plate pair 30. A second mounting bar 33 having a second mounting bar upper distal end is pivotally mounted between the second mounting plate pair 31, with the first and second mounting bars 32 and 33 extending downwardly relative to the first and second mounting plate pairs 30 and 31 in a canted orientation defining respective acute included angles between the first and second mounting bars 32 and 33 and the respective scaffold first and second tubes 27 and 28. The first and second mounting bars 32 and 33 include respective first and second slide tubes 34 and 35. The first and second slide tubes 34 and 35 include respective first and second stabilizer rods 37 and 38 arranged in a parallel relationship relative to one another, as indicated in FIG. 6, with the first stabilizer rod 37 directed towards the second mounting bar and the second mounting bar and the second stabilizer rod 38 extending towards the first mounting bar. It should be noted, as indicated in FIG. 8, that a plurality of plate pair fasteners 36 are secured to each of the first and second mounting plate pairs 30 and 31 and through the respective scaffold first and second tubes 27 and 28 to mount the first plate pair and the second plate pair 30 and 31 to the respective scaffold first tube 27 and the scaffold second tube 28.

The first stabilizer rod 37 includes a first stabilizer rod slide tube 39 mounted slidably along the first stabilizer rod 37, with a second stabilizer rod slide tube 40 slidably mounted along the second stabilizer rod 38. The first stabilizer slide tube 39 includes a respective first and second internally threaded fastener tube 41 and 42 respectively mounted in a spaced relationship along the first stabilizer rod slide tube 39. A respective third and fourth stabilizer tube 43 and 44 are mounted along the second stabilizer rod slide tube 40 in a spaced relationship such that the first and third fastener tubes 41 and 43 are coaxially aligned with the second and fourth fastener tubes 42 and 44 coaxially aligned. A first fastener rod 45 is slidably directed through the third tube 43 and threadedly directed into the first fastener tube 41, with a second fastener rod 46 slidably directed through the fourth fastener tube 44 and threadedly received within the second fastener tube 42. In this manner, the first and second scaffold tubes 27 and 28, as well as the scaffold structure in its entirety, is securely mounted and stabilized when positioned in a clamped orientation between the first and second stabilizer rod slide tubes 39 and 40 as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A scaffold stabilizer apparatus for securement to a scaffold assembly, having a scaffold first tube spaced from a scaffold second tube in a parallel relationship, and a scaffold top tube mounted to the first tube and second tube in a fixed relationship, wherein the apparatus comprises, a first mounting plate pair arranged for securement to the scaffold first tube and a second mounting plate pair arranged for securement to the scaffold second tube, with a plurality of first plate fasteners directed through the first plate pair, and a plurality of second plate fasteners directed through the second plate pair for securement of the first plate to the first tube and the second plate pair to the second tube respectively, and a first mounting bar having a first end pivotally mounted between the first plate pair canted downwardly therefrom, with a second mounting bar having a second mounting bar first end pivotally mounted between the second plate pair, and a first stabilizer rod slide tube slidably mounted along the first mounting bar, and a second stabilizer slide tube slidably mounted along the second mounting bar, and first securement means mounted to the first slide tube and second securement means mounted to the second slide tube for securement of the scaffold assembly between the first securement means and the second securement means, and the first securement means includes a first stabilizer rod pivotally mounted to the first slide tube directed towards the second mounting bar, and the second securement means includes a second stabilizer rod pivotally mounted to the second slide tube directed towards the first mounting bar, and the first securement means further includes a first stabilizer rod tube slidably mounted along the first stabilizer rod, and the second securement means further includes a second stabilizer rod tube slidably mounted along the second stabilizer rod, wherein the first stabilizer rod tube and the second stabilizer rod tube are arranged in a parallel, coextensive, and confronting relationship relative to one another, and the first stabilizer rod tube includes a first internally threaded fastener tube and a second internally threaded fastener tube, wherein the first internally threaded fastener tube and the second internally threaded fastener tube are spaced apart a predetermined spacing, and the second stabilizer rod tube includes a third fastener tube coaxially aligned with the first fastener tube, and a fourth fastener tube fixedly mounted to the second stabilizer rod tube, with the fourth fastener tube coaxially aligned with the second internally threaded fastener tube, and a first fastener rod slidably received through the third fastener tube and threadedly received within the first fastener tube, and a second fastener rod slidably received through the fourth fastener tube threadedly received within the second fastener tube.

* * * * *